United States Patent [19]

Fujie et al.

[11] 4,419,003

[45] Dec. 6, 1983

[54] RECORDING SHEET CONVEYING SYSTEM OF PRESSURE FIXING TYPE ELECTROSTATIC PRINTING APPARATUS

[75] Inventors: Masakatsu Fujie, Ibaraki; Junichi Matsuno, Toride; Masao Furuya, Yokohama, all of Japan

[73] Assignee: Hitachi, Ltd., Tokyo, Japan

[21] Appl. No.: 290,563

[22] Filed: Aug. 6, 1981

[30] Foreign Application Priority Data

| | | | |
|---|---|---|---|
| Aug. 27, 1980 | [JP] | Japan | 55-117111 |
| Sep. 26, 1980 | [JP] | Japan | 55-132898 |
| Oct. 31, 1980 | [JP] | Japan | 55-152097 |
| Nov. 12, 1980 | [JP] | Japan | 55-158294 |

[51] Int. Cl.[3] ..... G03G 15/20

[52] U.S. Cl. ..... 355/3 FU; 219/216; 226/24; 226/38; 271/251; 355/3 SH

[58] Field of Search ..... 355/3 SH, 14 SH, 3 FU; 271/251, 272, 273, 274; 226/172, 24, 38; 219/216

[56] References Cited

U.S. PATENT DOCUMENTS

| | | | |
|---|---|---|---|
| 2,461,376 | 2/1949 | Feldmeir | 271/274 |
| 3,120,794 | 2/1964 | Gold | 271/272 X |
| 4,269,594 | 5/1981 | Umans | 355/3 FU |
| 4,339,194 | 7/1982 | Scribner | 355/3 FU |

*Primary Examiner*—Richard L. Moses

*Attorney, Agent, or Firm*—Antonelli, Terry & Wands

[57] ABSTRACT

An electrostatic printing apparatus of the pressure fixing type having a toner image formed on a recording sheet fixed by applying pressure, including a tension imparting device for imparting to the recording sheet a tension oriented in the direction of travel of the recording sheet and a tension oriented in a direction perpendicular to the direction of its travel, and a regulating device for regulating the angle and posture of the recording sheet located in the path of movement of the recording sheet immediately before a pressure fixing roller device. The recording sheet is kept in taut condition as it is fed to the pressure fixing roller device to enable wrinkling, jamming and skewing of the recording sheet to be avoided.

17 Claims, 18 Drawing Figures

RECORDING SHEET CONVEYING SYSTEM OF PRESSURE FIXING TYPE ELECTROSTATIC PRINTING APPARATUS

BACKGROUND OF THE INVENTION

1. Field of the Invention

This invention relates to a recording sheet conveying system of a pressure fixing type electrostatic printing apparatus, such as a facsimile terminal, copying apparatus, printer, etc., using a dry toner.

2. Description of the Prior Art

Nowadays, fixing of a facsimile print of the original copy transmitted by a facsimile terminal of the electrostatic printing type shows a tendency to rely more and more on pressure rather than heat and light, to perform the operation at increased speed and enhanced safety while conserving energy.

A pressure fixing type dry electrostatic printing apparatus includes a pair of pressing rollers through which a sheet having no image fixed thereto is passed, to obtain fixing of a toner image to the surface of the recording sheet.

No satisfactory results have been obtained with a pressure fixing system of the prior art in a copying apparatus and a facsimile terminal. This is largely because the pressure used for fixing an image is set at a low level to reduce the incidence of wrinkling and jamming of a recording sheet (which refer to the phenomenon of the copying sheet becoming wrinkled during conveying and making it impossible to continue conveying). The results achieved by pressure fixing can be increased by raising the pressure applied. However, an increase in pressure might render the pressure applied between the fixing rollers nonuniform, thereby causing irregularities in the fixed image and wrinkles in the sheet to be produced.

Thus the practice of fixing an image to a recording sheet in a pressure fixing system requires feeding of the recording sheet to the pressing rollers at an angle and with a posture that do not cause wrinkling, jamming and skewing (the phenomenon of sheet moving obliquely in the conveyed direction without moving straight ahead) of the sheet to occur.

Since the recording sheet fed between the pressing rollers has on its surface a toner image not yet fixed thereto, it is impossible for the operator to arbitrarily touch the sheet, so that difficulties are experienced to place the sheet in good condition to avoid wrinkling, jamming and skewing. Thus skewing of a sheet of a certain degree has been tolerated so long as formation of wrinkles can be avoided.

In the prior art of avoiding wrinkle formation, proposals have been made, as disclosed in Japanese Patent Publication No. 45802/77 and Japanese Utility Model Application Laid-open No. 38313/80, to provide a guide plate located in a position immediately before the recording sheet is introduced between the pair of fixing rollers in such a manner that opposite side edges of the guide plate are disposed on the line of contact of the pair of rollers, above it or below it, so as to avoid wrinkle formation in the sheet by virtue of the difference in the axial direction in the peripheral velocity between the rollers forming the pair.

However, with an increase in the speed of operation and better results achieved in fixing, the pressure at which the rollers force against each other increases and it has become difficult to positively avoid wrinkle formation merely by means of the guide plate. Moreover, difficulties have been experienced in correcting the skewing that inevitably occurs depending on the printing condition, such as when the recording sheet is white in its left half and black in its right half, for example. Phenomenons, such as wrinkling, jamming and skewing, show a tendency to grow once they occur.

OBJECTS AND STATEMENT OF THE INVENTION

An object of the invention is to provide a pressure fixing type electrostatic printing apparatus capable of preventing wrinkling, jamming and skewing of a recording sheet while enabling satisfactory results to be obtained in fixing an image to the recording sheet.

Another object is to provide a pressure fixing type electrostatic printing apparatus capable of preventing wrinkling, jamming and skewing of a recording sheet by feeding the recording sheet to pressure fixing roller means in taut condition and positively inserting the leading end portion of the recording sheet between the pressing rollers under predetermined conditions.

The aforesaid objects can be accomplished by providing the pressure fixing type electrostatic printing apparatus with a recording sheet conveying system comprising developing means for forming a toner image on a recording sheet, conveyor means for conveying the recording sheet on which the toner image is formed, pressure fixing roller means for fixing by pressure the toner image on the recording sheet, first tension imparting means located anterior to the developing means for imparting to the recording sheet a tension oriented in a direction perpendicular to the direction of travel of the recording sheet, second tension imparting means for imparting to the recording sheet a tension oriented in the direction of travel of the recording sheet, and regulating means located immediately anterior to the pressure fixing roller means for regulating the angle and posture of the leading end of the recording sheet as it is introduced into the pressure fixing roller means.

Additional and other objects, features and advantages of the invention will become apparent from the description set forth hereinafter when considered in conjunction with the accompanying drawings.

Figure 8A:
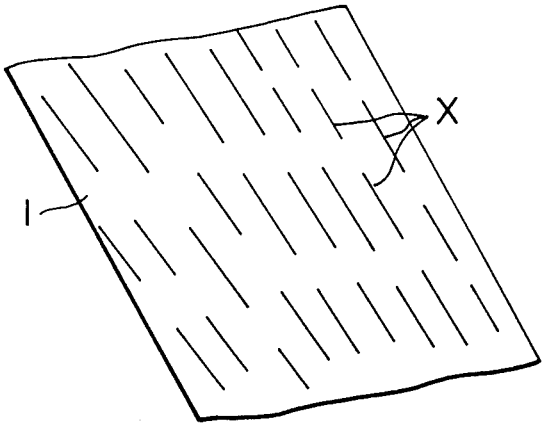
Figure 8B:
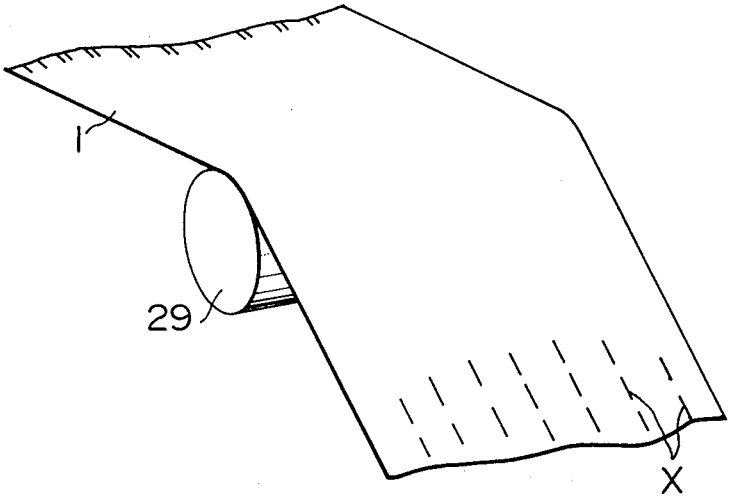
Figure 9:
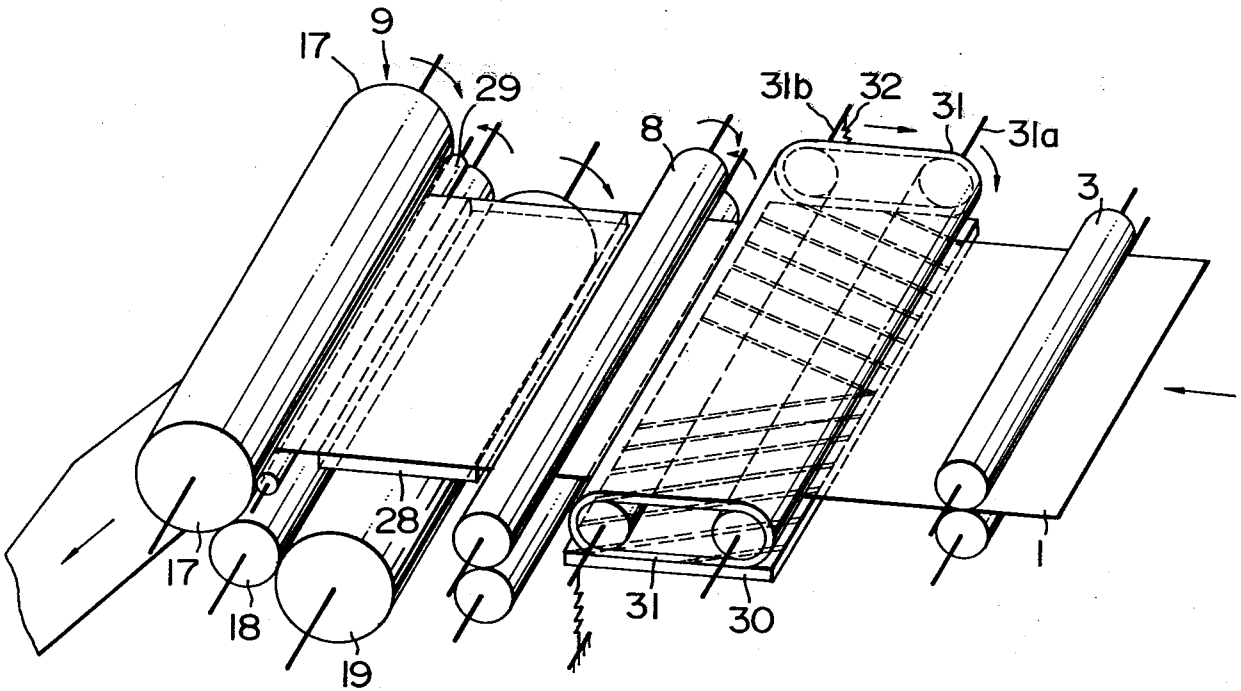
Figure 10:
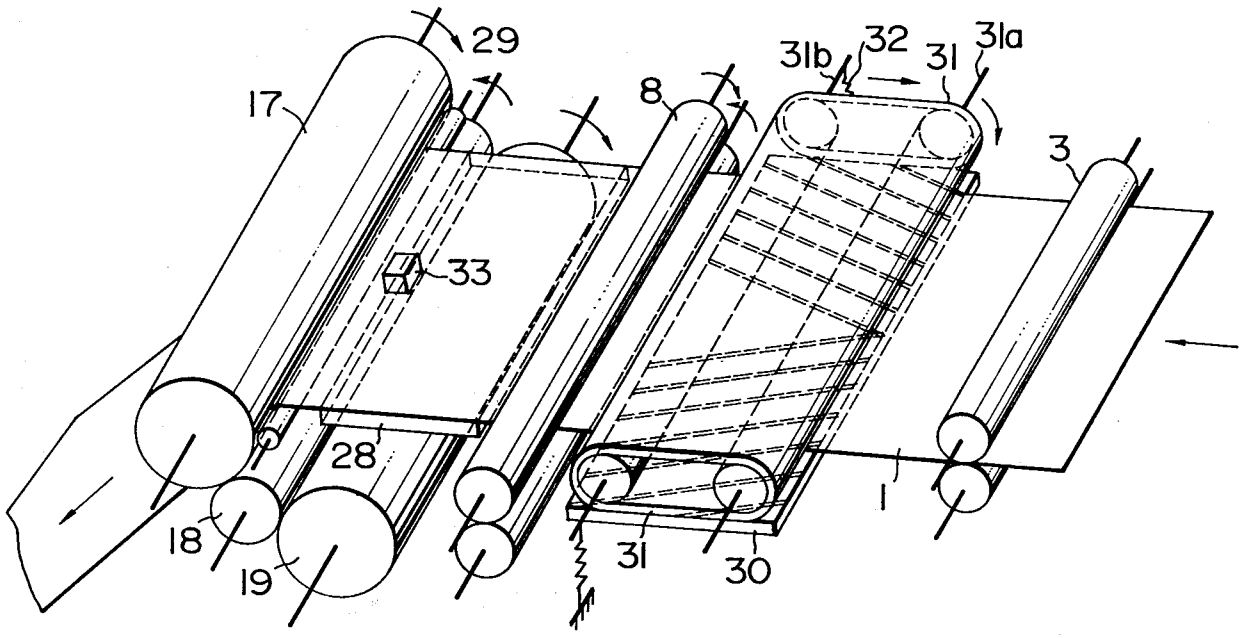

FIGS. *7a–7c* show the positional relation between the pressing roller section and the guide pin, FIG. *7a* being a front view, FIG. *7b* being a plan view and FIG. *7c* being a side view;

FIGS. 8*a* and 8*b* are views in explanation of the manner in which wrinkle formation if avoided, FIG. 8*a* showing the manner in which a recording sheet is conveyed in free condition and FIG. 8*b* showing the manner in which a recording sheet is curled;

FIG. 9 is a schematic side view of the recording sheet conveying system comprising another embodiment;

FIG. 10 shows one example of means for detecting a recording sheet being fed along its entire width to the pressing rollers; and FIGS. 11*a*–11*e* show one example of the condition of oscillation of an oscillatory tension produced by rendering oscillatory the pressing roller velocity.

DESCRIPTION OF THE PREFERRED EMBODIMENTS

Figure 1:
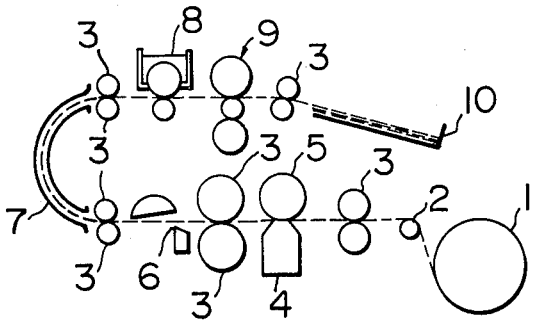
FIG. 1 is a view of the recording sheet travel system of a pressure fixing type facsimile terminal incorporating the present invention therein.
Figure 3:
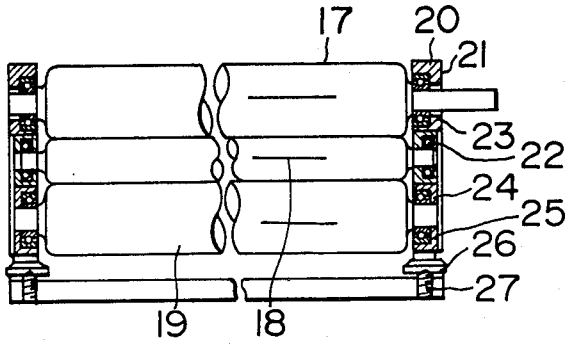
FIGS. 3–6 show one embodiment of the pressure fixing device in confirmity with the invention, FIG. 3 being a sectional side view, FIG. 4 being a plan view, FIG. 5 being a perspective view and FIG. 6 being a schematic side view.
Figure 4:
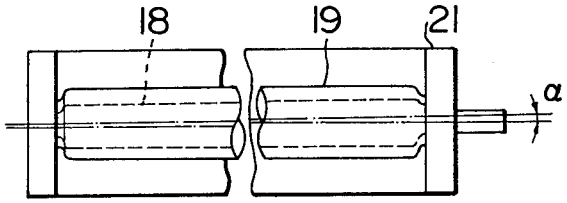

FIG. 1 shows the recording sheet travel system in its entirety of a receiver of a facsimile terminal of the pressure fixing type, in which a recording sheet 1 in the form of a roll has an electrostatic latent image printed thereon in the form of a facsimile print of the original copy handled, as the recording sheet 1 is passed by a recording sheet guide roller 2 and between a pair of recording sheet feed rollers 3 and a set of recording electrode 4 and a recording sheet holding roller 5. Upon completion of receiving of the facsimile record, the sheet 1 is severed by a cutter 6 after being released from the feeding rollers 3, from the rest of the sheet. The recording sheet 1 with the electrostatic latent image printed thereon is fed by another pair of feeding rollers 3 along a recording sheet guide plate 7 to a developing device 7 where the electrostatic latent image is developed into a visible image which is fixed at a pressing roller section 9. The copy sheet having the visible image fixed thereto at the pressing roller section is fed by still another pair of recording sheet feed rollers 3 to a received copy stocker 10 located outside the apparatus, to be stocked therein.

Figure 2:
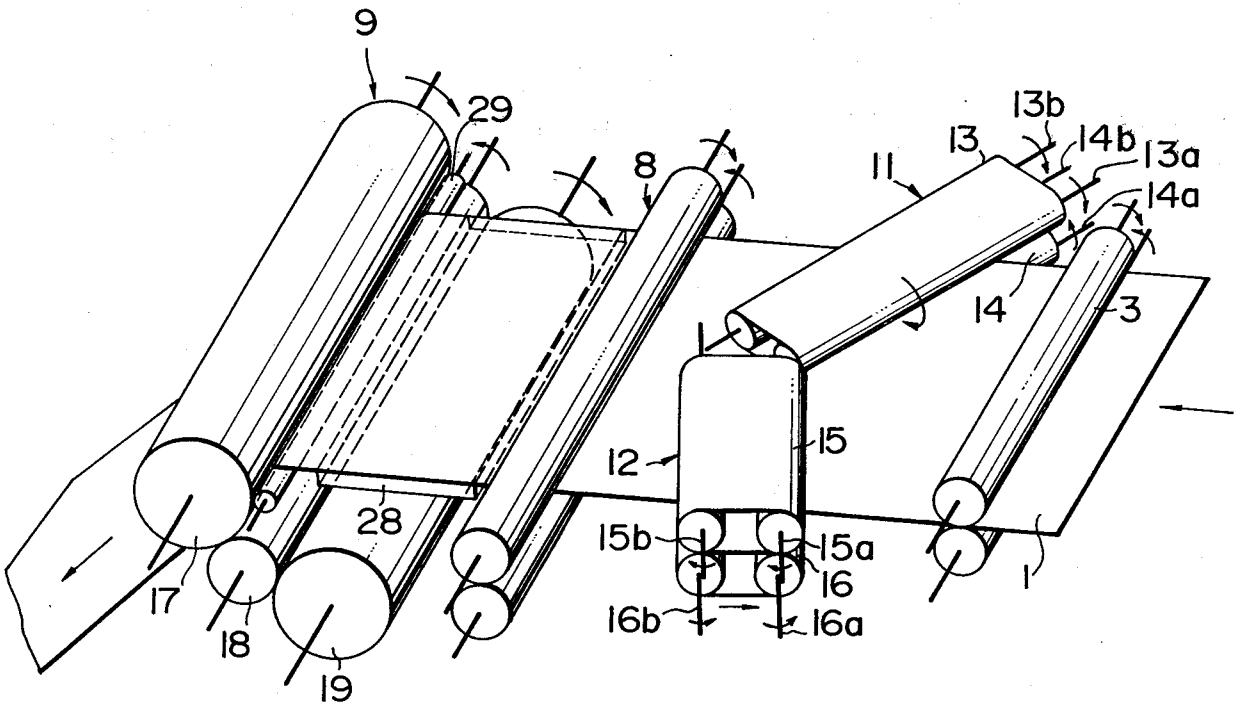
FIG. 2 is a schematic side view of the recording sheet conveying system comprising one embodiment of the invention.
Figure 5:
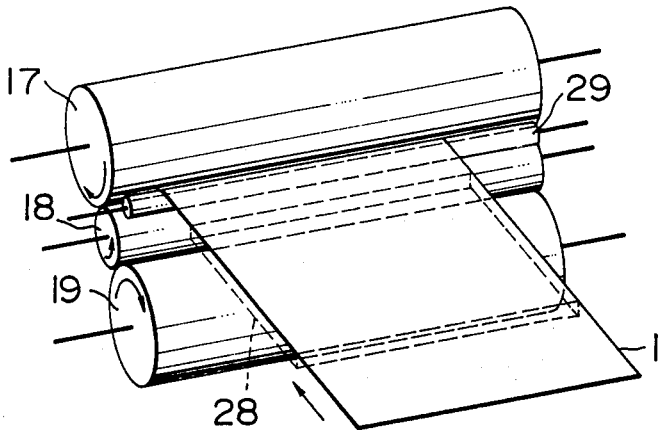
Figure 6:
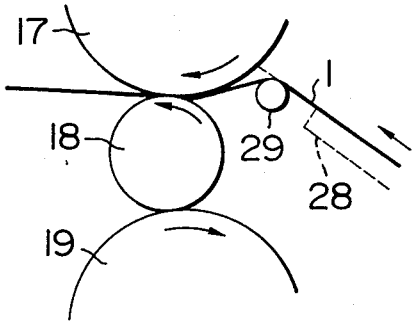
Figure 7A:
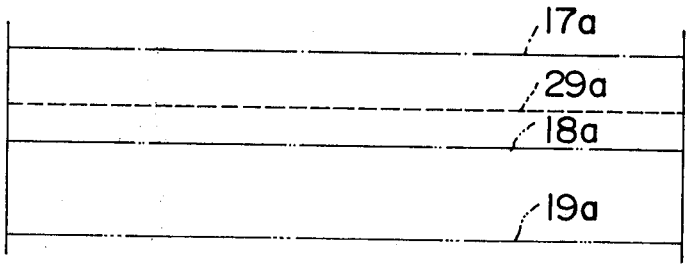
Figure 7B:
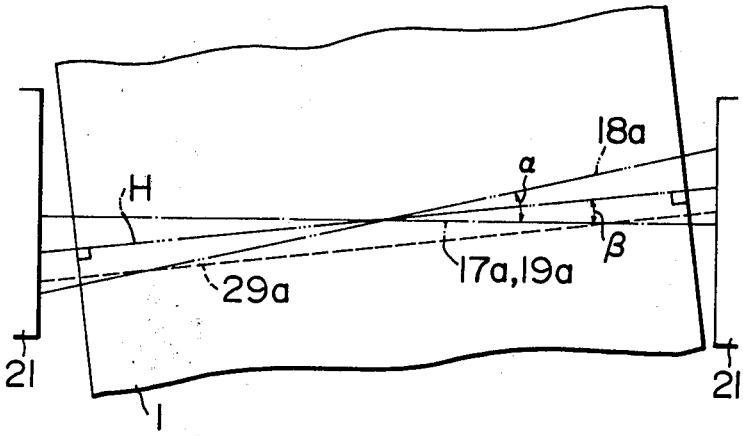
Figure 7C:
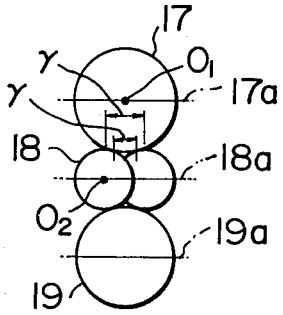

FIG. 2 shows the essential portions of the recording sheet conveying system according to the invention on an enlarged scale. In FIG. 2, parts similar to those shown in FIG. 1 are designated by like reference characters.

The recording sheet 1 having an electrostatic latent image formed thereon by the recording electrode 4 is fed by the recording sheet feeding rollers 3 to the developing section to have a toner image formed thereon by the developing device 8. According to the invention, a tension oriented in the direction in which the recording sheet 1 travels and a tension oriented in a direction perpendicular to the direction of travel of the recording sheet 1 or widthwise thereof are imparted to the recording sheet 1 before it is introduced into the developing device 8.

More specifically, conveying means 11 and 12 comprising pairs of conveyor belts 13 and 14 and 15 and 16 disposed in contact with the upper surface and undersurface of the recording sheet 1 respectively are arranged in directions symmetrical with respect to the center line of the direction of travel of the recording sheet 1 and forming a certain angle therewith. The upper conveyor belts 13 and 15 move on upper drive shafts **13*a* and 15*a* and upper friction shafts 13*b* and 15*b* on the recording sheet inlet side and the recording sheet outlet side respectively, and the lower conveyor belts 14 and 16 move on lower drive shafts 14*a* and 16*a* and lower friction shafts 14*b* and 16*b* on the recording sheets inlet side and the recording sheet outlet side respectively, so that the recording sheet 1 can be conveyed in taut condition as the shafts rotate in directions indicated by arrows. The spacing between the upper conveyor belts 13 and 15 and the lower conveyor belts 14 and 16 is such that the upper drive shafts 13*a* and 15*a* are spaced apart a larger distance from the lower drive shafts 14*a* and 16*a* respectively than the upper friction shafts 13*b* and 15*b* are spaced apart from the lower friction shafts 14*b* and 16*b* respectively, so that biasing force acts between the shafts at all times. More specifically, a gap exits on the drive shaft side while the friction shafts are in intimate contact with each other, so that the conveyor belts readily bite into the recording sheet. The force with which the conveyor belts bite into the recording sheet is increased as the recording sheet is conveyed, and at the same time the recording sheet has its left half portion pulled leftwardly and its right half portion pulled rightwardly with respect to the direction of its travel because the conveyor belts 13 and 14 and 15 and 16 are angled with respect to the center line of the recording sheet 1** as seen in the direction of its travel.

Moreover, by setting the velocity of rotation of the fixing roller section 9 at a value higher than the velocity of movement of the conveyor means 11 and 12, a tension oriented in the direction of travel of the recording sheet 1 is produced between a guide pin subsequently to be described and the conveyor belts 11 and 12. The tension produced by the conveyor means 11 and 12 can be spread to the position of the guide pin.

Thus the tension oriented in the direction of travel of the recording sheet and the tension oriented in a direction perpendicular to the direction of travel thereof are produced in the recording sheet in the position of the guide pin, to enable the recording sheet 1 to be fed to the pressing roller section 9 in taut condition.

The pressing roller section 9 comprises a first roller 17, a second roller 18 and a backup roller 19. The construction thereof will be described in detail by referring to FIGS. 3–8.

FIGS. 3–6 and 7*a*–7*c* show in detail the construction of the pressing roller section 9 in which the first roller 17 is journaled for rotation by bearings 20 in a housing 21. The second roller 18 maintained in pressing contact with the first roller 17 with their axes crossing each other at a very small angle $\alpha$ (see FIG. 4) is supported through bearings 22 by a guide member 23 formed in the housing 21, so that the second roller 18 can be moved vertically in the housing 21.

The backup roller 19 disposed parallel to the first roller 17 is supported through bearings 24 by another guide member 25 for vertical movement in the housing 21 like the second roller 18. The guide member 25 has attached to its lower portion an interroller loading spring 26 which is pressed by a setting screw 27. The force with which the setting screw 27 presses the spring 26 can be varied as desired by manipulating the setting screw 27.

As the guide member 25 is pressed by the interroller loading spring 26, the backup roller 19 presses against the second roller 18 which in turn is brought into pressing contact with the first roller 17.

The deflection of the second roller 18 that is produced when the recording sheet 1 passes between the first roller 17 and the second roller 18 is compensated for by the fact that the backup roller 19 and the first roller 17 have their axes cross the axis of the second roller 18 at an engle. The angle $\alpha$ of intersection between the axes causes a variation to occur in the speed of contact of the rollers with the recording sheet depending on the positions of the rollers, with a result that the toner is rubbed against the recording sheet 1 to achieve the desired results in fixing the image.

The recording sheet 1 having a toner image formed thereon as aforesaid is fed to the fixing roller section 9 by conveyor means 28. The conveyor means 28 may be provided with the function of imparting to the recording sheet 1 a tension oriented in the direction of travel thereof.

Means for regulating the angle and posture of the leading end of the recording sheet 1, such as a guide pin 29, by locally curling the sheet and removing widthwise wrinkles therefrom is located in the path of movement of the recording sheet in the vicinity of the recording sheet inlet of the pressing roller section 9. The pin 29 is disposed in a position higher than the position in which the rollers bite into the recording sheet.

The positional relation between the guide pin 29 and the pressing roller section 9 will be described by referring to FIGS. *7a–7c*, in which FIGS. *7a*, *7b* and *7c* are a front view, a plan view and a side view respectively. As shown in FIG. *7a*, the first roller 17, second roller 18 and backup roller 19 have center lines 17*a*, 18*a* and 19*a* respectively which are parallel to one another in a vertical plane, and the guide pin 29 has a center line 29 which is also parallel to the center lines 17*a*, 18*a* and 19*a* in a vertical plane.

As shown in FIG. *7b*, the center line 17*a* of the first roller 17 is parallel to the center line 19*a* of the backup roller 19 in a horizontal plane, but the center line 18*a* of the second roller 18 is at the aforesaid angle $\alpha$ with respect to the center lines 17*a* and 19*a*. The first roller 17 and the second roller 18 are in contact along a line H which forms an angle $\beta$ with the center lines 17*a* and 19*a*. The center line 29*a* of the guide pin 29 is parallel to the line of contact H between the first roller 17 and second roller 18, and at a right angle to the direction of travel of the recording sheet 1.

As shown in FIG. *7c*, the crossing angle $\alpha$ produces a difference between the center point $O_1$ of the first roller 17 and the center point $O_2$ of the second roller 18 on opposite sides of the housing 21 which is equal to the displacement $\gamma$ of the crossing angle of the second roller while the line of contact H between the first roller 17 and second roller 18 produces a difference on opposite sides of the housing 21 which is equal to the displacement $\gamma'$ of the crossing angle of the contact line. Thus the crossing angle $\beta$ is produced.

Operation of the embodiment shown and described hereinabove will be described. The recording sheet 1 having an electrostatic latent image formed thereon by the recording electrode 4 is fed by the recording sheet feeding rollers 3 to the developing section where a toner image is formed on the recording sheet 1 by the developing device 8. Prior to introduction into the developing device 8, the recording sheet 1 is tensioned in the direction of its travel and in a direction perpendicular to the direction of its travel by virtue of the difference between the velocity of rotation of the pressing roller section 9 and the velocity of movement of the conveyor means 11 and 12, so that the recording sheet 1 is brought to a taut condition.

Developing of the image on the recording sheet 1 is completed while it is kept in the taut condition. The recording sheet 1 having a toner image formed thereon as the result of developing is moved by the conveyor means 28 and passes above the guide pin 29 to impinge on the first roller 17. Rotation of the first roller 17 delivers the recording sheet 1 to the first roller 17 and second roller 18.

At this time, the recording sheet 1 may be delivered by the conveyor means 28 in any direction as desired so long as it passes over the guide pin 29 and impinges on the first roller 17 so as to be fed between the first roller 17 and second roller 18 by rotation of the first roller 17.

While being fed between the first and second rollers 17 and 18, the recording sheet 1 is kept in contact with the guide pin 29 at all times. The side on which the recording sheet 1 is in contact with the guide pin 29 is the underside thereof, so that no damage is done to the image on the upper side of the recording sheet 1 by the guide pin 29.

FIGS. 8*a* and 8*b* show the recording sheet 1 in condition in which it is being conveyed. In FIGS. 8*a*, the recording sheet 1 is shown as being conveyed freely, with wrinkles being more or less formed as indicated by x. However, by positioning the guide pin 29 on the underside of the recording sheet 1 as shown in FIG. 8*b*, the recording sheet 1 can be locally curled to remove the wrinkles from the curled portions.

Thus the provision of the guide pin 29 for curling the recording sheet 1 in a position very close to the pressing roller section 9 offers the advantage that the wrinkles developing in the recording sheet before and after the guide pin 29 can be removed.

FIG. 9 shows another embodiment in which parts similar to those shown in FIG. 2 are designated by like reference characters. In this embodiment, a friction plate 30 and a conveyor belt 31 are used as means for imparting to the recording sheet 1 a tension oriented widthwise thereof.

The friction plate 30 is formed on the surface thereof contacting the recording sheet 1 with a plurality of elevated and depressed areas extending from the center line of the recording sheet 1 toward opposite sides thereof at a certain angle thereto and arranged symmetrically with respect to the center line, to apply a drag on the recording sheet 1 and cause same to difficultly move in sliding movement. The conveyor belt 31 is trained over a drive shaft 31*a* disposed on the sheet inlet side and a friction shaft 31*b* disposed on the sheet outlet side and moves thereover in the direction of an arrow, so as to thereby convey the recording sheet 1.

The friction plate 30 and the conveyor belt 31 are spaced apart from each other on the drive shaft 21*a* side to facilitate introduction of the recording sheet 1. On the friction shaft 31*b* side, the friction shaft 31*b* forces the conveyor belt 31 against the friction plate 30 by a frictional force spring 32. Thus a tension oriented in the direction of travel of the recording sheet 1 and a tension oriented perpendicular to the direction of travel of the recording sheet 1 are imparted to the recording sheet 1 from the time it is introduced into the conveyor system according to the invention on the drive shaft 31*a* side to the time it is released therefrom on the friction shaft 31*b* side.

After the recording sheet 1 is bitten by the rollers of the pressing roller section 9, the recording sheet 1 can be tensioned in the direction of its travel between the guide pin 29 and the conveyor belt 31 by setting the velocity of rotation of the pressing roller section 9 at a higher value than that of the conveyor belt 31. As the recording sheet 1 is tensioned in this way, the tension oriented in a direction perpendicular to the direction of travel of the recording sheet imparted to the recording sheet 1 between the friction plate 30 and the conveyor belt 31 can be extended to the position of the pressure fixing guide pin 29. Thus in the position of the guide pin 29 or immediately before the recording sheet 1 is introduced into the pressing roller section 9, the recording sheet 1 is tensioned both in the direction of its travel and in a direction perpendicular to the direction of its travel, to enable the recording sheet 1 to be kept taut when introduced into the pressing roller section 9.

In the embodiment shown and described hereinabove, a frictional force is used for tensioning the recording sheet 1. It is to be understood that the invention is not limited to the use of this specific force and that any other suitable force, such as an electrostatic force, an air current, etc., may be used.

FIG. 10 shows one example of means for sensing the introduction of a recording sheet into the pressing roller section 9 along its entire width. In the figure, parts similar to those shown in FIG. 2 are designated by like reference characters. A leading end detector 33 detects the arrival of a recording sheet 1 immediately before the guide pin 29. The detector 33 may be of any suitable form, such as a light transmitting sensor, a light reflecting sensor, an electrostatic capacity type sensor, a limit switch, etc. A control unit, not shown, does calculation on the introduction of the recording sheet 1 along its entire width into the pressing rollers, based on the velocity of rotation of the drive shaft 31*a* of the conveyor belt 31 for tensioning the recording sheet 1 and the distance between the sheet leading end detector 33 and the pressing rollers of the pressing roller section 9. Based on the result of calculation done by the control unit, the velocity of rotation of the pressing rollers of the pressing roller section 9 is increased with a suitable time lag behind the production of a detection signal by the sheet leading end detector 33, to tension the recording sheet 1 between the pressing roller section 9 and the conveyor belt 31. When the recording sheet 1 is tensioned in this way, slip is produced between the conveyor belt 31 and the recording sheet 1. Thus it is necessary that electrically conductive rubber belt be used for the conveyor belt 31 and ground same, to avoid electrostatic buildup on the recording sheet 1. Alternatively the recording sheet 1 may be tensioned by controlling the drive torque of the conveyor belt 31 which may be detected by using a roller pressing load, a drive motor current, etc.

Figure 11A:
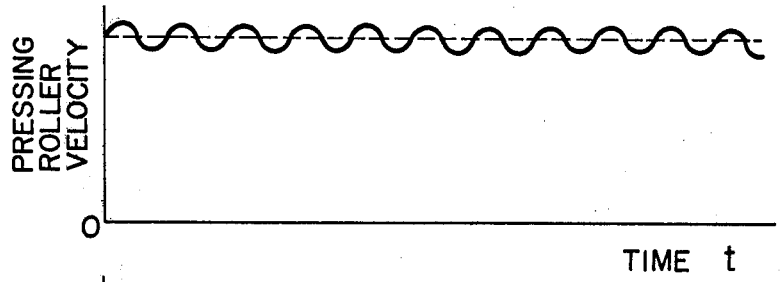
Figure 11B:
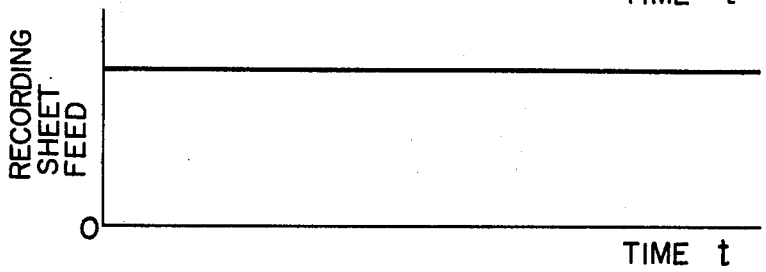
Figure 11C:
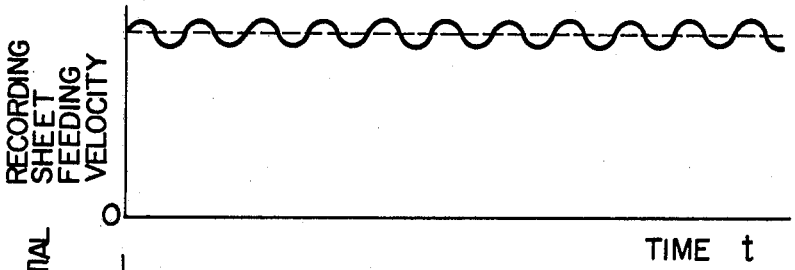
Figure 11D:
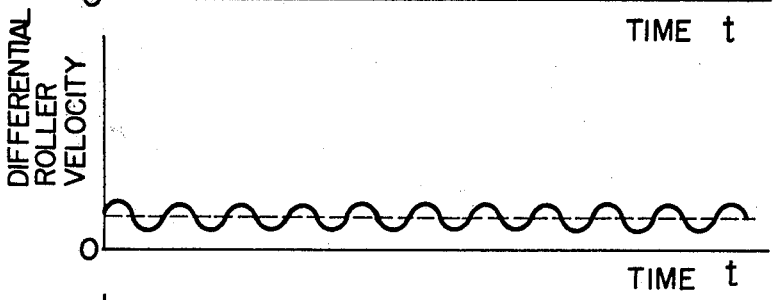
Figure 11E:
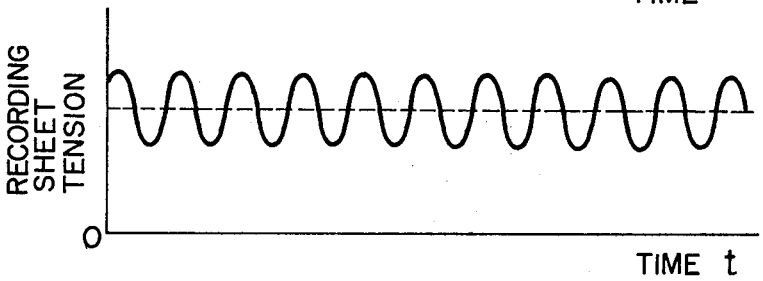

FIGS. 11*a*–11*e* show the relation between the velocity of the pressing rollers, the velocity for feeding a recording sheet and the tension imparted to the recording sheet for oscillatorily tensioning the recording sheet. The velocity of the pressing rollers can be rendered by rendering the velocity of rotation of the pressing roller drive motor, and the velocity of rotation of the pressing rollers can be rendered by rendering oscillatory the voltage impressed on the motor which can be readily effected. Thus the velocity of the pressing rollers can be readily rendered oscillatory. For example, when the velocity of the pressing rollers is rendered vibratory or $v_1+v_1'$ sin t as shown in FIG. 11*a* and the velocity of the recording sheet feeding roller is kept constant as shown in FIG. 11*b*, the tension imparted to the recording sheet can be rendered oscillatory or $F+F'$ sin t as shown in FIG. 11*e*. Since a very high pressure fixing force is required for obtaining satisfactory fixing of a toner image to a recording sheet by means of the pressing rollers, the velocity of feeding a copy sheet becomes substantially equal to the velocity of the pressing rollers as shown in FIG. 11*c*. Therefore, by causing the pressing roller velocity and the recording sheet feeding velocity to differ from each other as shown in FIG. 11*d* to tension the recording sheet, the difference in velocity produces slip between the recording sheet feeding roller and the recording sheet due to frictional drag. Thus little effect can be achieved by rendering the velocity oscillatory on the recording sheet feeding roller side and keeping it constant on the pressing roller side. In FIG. 11, the pressing roller velocity is shown as undergoing a sine wave form oscillation of $v_1+v_1'$ sin t. However, the invention is not limited to this form of variation, and any variation that is oscillatory, such as saw-tooth-like variation, rectangular wave form variation, may be used. This has the additional effect of being able to correct skewing in a relatively high frequency range (several tens of Hz).

By imparting oscillatory tension to a recording sheet by a mechanism of simple construction for providing the system with additional functions, it is possible to avoid wrinkling, jamming and skewing of the recording sheet. Additionally any skewing that might be produced can be removed when a toner image is fixed by pressure fixing. Thus the invention provides a facsimile terminal of the pressure fixing type that can handle a recording sheet of very large length without any trouble. That is, the electrostatic printing apparatus of the pressure fixing type provided by the invention is capable of avoiding wrinkling, jamming and skewing of a recording sheet by a simple mechanism while enabling satisfactory fixing of a toner image to be obtained.

What is claimed is:

1. A recording sheet conveying system of an electrostatic printing apparatus of the pressure fixing type comprising:

developing means for forming a toner image on a recording sheet;

conveyor means for conveying the recording sheet having the toner image formed thereon;

pressure fixing roller means for fixing by pressure the toner image on the recording sheet;

first tension imparting means located anterior to said developing means for imparting to the recording sheet a tension oriented in a direction perpendicular to the direction of travel of the recording sheet, said first tension imparting means comprising at least one conveyor belt means having a tensioning surface area thereof extending laterally so as to at least substantially span the width of a path traveled by said recording sheet;

second tension imparting means for imparting to the recording sheet a tension oriented in the direction of travel of the recording sheet; and regulating means located immediately anterior to said pressure fixing roller means for regulating the angle and posture of the leading end of the recording sheet as it is introduced into the pressure fixing roller means.

2. A recording sheet conveying system as claimed in claim 1, wherein said first tension imparting means comprises a plurality of conveyor belts located on the upper side and the underside of the recording sheet in juxtaposed relation, so that the recording sheet can be conveyed by these conveyor belts in directions which deviate leftwardly and rightwardly with respect to the direction of travel of the recording sheet.

3. A recording sheet conveying system as claimed in claim 2, wherein the spacing between the juxtaposed conveyor belts becomes smaller in going in the direction of travel of the recording sheet.

4. A recording sheet conveying system as claimed in claim 1, wherein said first tension imparting means comprises a conveyor belt located on the upper surface of the recording sheet and a frictional drag imparting means located on the underside of the recording sheet.

5. A recording sheet conveying system as claimed in claim 4, wherein said second tension imparting means is provided by setting the velocity of rotation of said pressure fixing roller means at a value higher than that of the conveyor belts.

6. A recording sheet conveying system as claimed in claim 1, wherein said regulating means comprises a guide pin.

7. A recording sheet conveying system as claimed in claim 6, wherein said guide pin is located in a position higher than the position in which the recording sheet introduced into the pressure fixing roller is bitten by the rollers.

8. A recording sheet conveying system as claimed in claim 7, wherein said pressure fixing roller means comprises a first roller, a second roller crossing said first roller at a very small angle, and a backup roller in contact with said second roller and disposed parallel to said first roller, and wherein said guide pin is arranged such that its center line is parallel to the line of contact between the first and second rollers and perpendicular to the direction of travel of the recording sheet.

9. A recording sheet conveying system as claimed in claim 1 further comprising control means for detecting the introduction of the recording sheet along its entire width into the pressure fixing roller means and controlling the operation in such a manner that the recording sheet is tensioned by a detection signal issued by the control means.

10. A recording sheet conveying system as claimed in claim 9, wherein said means for detecting the introduction into the pressure fixing roller means the recording sheet along its entire width detects the leading end of the recording sheet immediately before the latter is introduced into the pressure fixing roller means during its travel.

11. A recording sheet conveying system as claimed in claim 9, wherein said control means is operative to do calculation on the time elapsing after a recording sheet leading end detecting signal is generated until the recording sheet is introduced into the pressure fixing roller means based on the recording sheet feeding velocity, and switching the pressure fixing roller velocity with a lag of the time obtained by the calculation behind the recording sheet leading end detecting signal generating time.

12. A recording sheet conveying system as claimed in claim 9, wherein said means for detecting the introduction into the pressure fixing roller means the recording sheet along its entire width detects a variation in the drive torque of the pressure fixing rollers during travel of the recording sheet.

13. A recording sheet conveying system as claimed in claim 1, further comprising a pressure fixing roller drive motor with a variable rotational velocity, the recording sheet being tensioned as the rotational velocity of said drive means is oscillatorily varied.

14. A recording sheet conveying system of an electrostatic printing apparatus of the pressure fixing type comprising:

developing means for forming a toner image on a recording sheet;

conveyor means for conveying the recording sheet having the toner image formed thereon;

pressure fixing roller means for fixing by pressure the toner image on the recording sheet as it passes through a nip thereof;

first tension imparting means located anterior to said developing means for imparting to the recording sheet a tension oriented in a direction perpendicular to the direction of travel of the recording sheet;

second tension imparting means for imparting to the recording sheet a tension oriented in the direction of travel of the recording sheet; and regulating means located immediately anterior to said pressure fixing roller means in a position displaced from a plane in which said recording sheet is conveyed to alter the direction in which the recording sheet is conveyed, said regulating means being disposed such that its length is parallel to the axis of each roller of said pressure fixing roller means in a vertical plane and parallel to a line of contact of rollers in said nip of said fixing roller means in a horizontal plane, said line of contact intersecting the axis of the rollers of the fixing roller means.

15. A recording sheet conveying system as claimed in claim 2, wherein said second tension imparting means is provided by setting the velocity of rotation of said pressure fixing roller means at a value higher than that of the conveyor belts.

16. A recording sheet conveying system as claimed in claim 3, wherein said second tension imparting means is provided by setting the velocity of rotation of said pressure fixing roller means at a value higher than that of the conveyor belts.

17. A recording sheet conveying system as claimed in claim 1, wherein said first tension imparting means is located anterior to said developing means to impart to a recording sheet a tension oriented at right angles to the direction of travel of the recording sheet by a member having a large length and a large width of contact with the recording sheet widthwise thereof.

* * * * *